United States Patent [19]

Smith

[11] 4,034,429

[45] July 12, 1977

[54] INNER SPRING CONSTRUCTION FOR MATTRESSES, CUSHIONS AND THE LIKE

[76] Inventor: Lewis M. Smith, 38 Richland Ave., San Francisco, Calif. 94110

[21] Appl. No.: 680,738

[22] Filed: Apr. 27, 1976

[51] Int. Cl.[2] ..... A47C 23/04; A47C 25/00

[52] U.S. Cl. ..... 5/256; 5/248; 5/230

[58] Field of Search ..... 5/247, 248, 254, 256, 5/260, 351, 353

[56] References Cited

U.S. PATENT DOCUMENTS

| | | | |
|---|---|---|---|
| 2,001,964 | 5/1935 | Kimbrig | 5/256 |
| 2,617,123 | 11/1952 | Mayer | 5/260 |
| 3,093,840 | 6/1963 | Martin | 5/260 |
| 3,716,874 | 2/1973 | Thomas | 5/256 |

*Primary Examiner*—Casmir A. Nunberg
*Attorney, Agent, or Firm*—Allen D. Brufsky

[57] ABSTRACT

A spring construction for use as an inner spring for a mattress or cushion. The spring is in the form of helical core including concave and convex side portions which when placed in adjacent rows overlap and intermesh to provide firm support for a body and aid in preventing sag and collapse of any individual spring.

1 Claim, 3 Drawing Figures

INNER SPRING CONSTRUCTION FOR MATTRESSES, CUSHIONS AND THE LIKE

BACKGROUND OF THE INVENTION

This invention relates to an inner spring construction for use in the interior of a mattress, cushion or the like.

In the construction of a spring assembly for use in the interior of a mattress, cushion and the like, it is customary to arrange helical coil springs in columns and rows, with the rows being spaced apart and the individual springs in the row being immediately adjacent to each other. Tie wires extend between the rows to tie the rows together into a unitary spring asssembly or the springs are encased in cells such as cloth sleeves which are stitched together.

SUMMARY OF THE INVENTION

This invention provides a spring for use in such an assembly having a unique configuration which provides resiliency so the mattress or cushion can conform comfortably to the body of the user, but which can be readily intermeshed for added firmness and the prevention of collapse or sagging of any portion of the spring assembly. To accomplish this objective, a helical coil spring is disclosed whose sides have concave and convex arcuate portions which when placed in adjacent rows will overlap and intermesh.

BRIEF DESCRIPTION OF THE DRAWING

Further objects and advantages of the invention will become more apparent from the following description and claims, and from the accompanying drawing, wherein:

DETAILED DESCRIPTION OF THE PREFERRED EMBODIMENT

Figure 1:
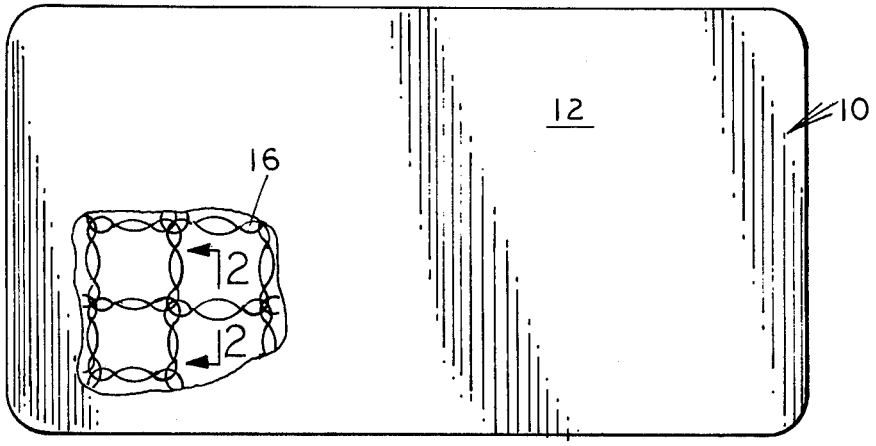
FIG. 1 is a top plan view of a mattress having inner springs formed in accordance with the present invention, a portion of the mattress being removed to illustrate the interengagement of the spring construction.

Referring now to the drawing in detail, wherein like numerals indicate like elements throughout the several views, a mattress 10 having a fabric cover 12 and a foam rubber lining 14 is provided a plurality of intermeshed inner springs 16 comprising the subject of the present invention. Springs 16 are disposed between opposite portions of the lining 14 of mattress 10 so that the mattress can readily conform to the body of the user for support and comfort.

Figure 2:
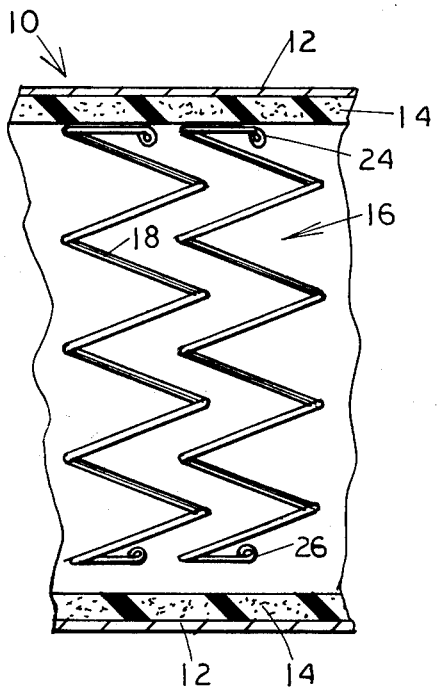
FIG. 2 is an enlarged cross-sectional view of the spring construction of FIG. 1 taken substantially along the plane indicated by line 2—2 of FIG. 1.
Figure 3:
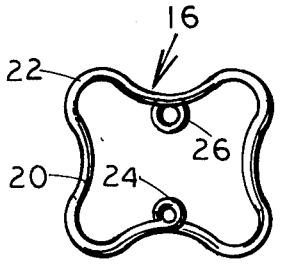
FIG. 3 is a top plan view of one of the springs shown in FIG. 2.

Springs 16 include a wire body 18 wound into a helical coil as shown in FIG. 2 for resiliency. The sides of the helical coil spring 16 have concave portions 20 connected to convex corners 22 which when placed in adjacent rows will overlap and intermesh as shown in FIGS. 1 and 2 for added firmness of mattress 10 and for increased prevention of sag or collapse of the individual springs 16.

The top and bottom coils of spring 16 are flat and have ends turned into loops 24 and 26, respectively, for safety to prevent the ends of the spring from piercing lining 14 and possibly emerging through fabric cover 12.

I claim:

1. A spring construction for use in an inner spring mattress or the like comprising helical coil springs, each said spring consisting of (1) a plurality of central coils having concave side portions and convex corner portions, and (2) flat top and bottom coils each having an end looped upon itself.

* * * * *